US011193365B2

(12) United States Patent
Simeonov et al.

(10) Patent No.: US 11,193,365 B2
(45) Date of Patent: Dec. 7, 2021

(54) DESICCATING MODULE TO REDUCE MOISTURE IN DOWNHOLE TOOLS

(71) Applicant: HALLIBURTON ENERGY SERVICES, INC., Houston, TX (US)

(72) Inventors: Svetozar D. Simeonov, Houston, TX (US); Clint P. Lozinsky, Kingwood, TX (US); Michael Dewayne Finke, Cypress, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/458,157

(22) Filed: Jun. 30, 2019

(65) Prior Publication Data

US 2020/0408080 A1 Dec. 31, 2020

(51) Int. Cl.
*E21B 47/017* (2012.01)
*E21B 27/00* (2006.01)

(52) U.S. Cl.
CPC ..... *E21B 47/017* (2020.05); *E21B 27/00* (2013.01)

(58) Field of Classification Search
CPC ..... E21B 47/017; E21B 27/00; E21B 41/00
See application file for complete search history.

(56) References Cited

U.S. PATENT DOCUMENTS 2,706,406 A * 4/1955 Vincent ..... G01F 1/103 73/152.31
2003/0056982 A1 3/2003 Fayard et al.
2008/0277162 A1* 11/2008 DiFoggio ..... E21B 47/017 175/17
2012/0097385 A1* 4/2012 Villareal ..... E21B 49/10 166/162
2014/0102796 A1 4/2014 Veneruso et al.
2015/0377007 A1* 12/2015 Pauchet ..... E21B 41/00 166/381

FOREIGN PATENT DOCUMENTS

CN 205561050 U 9/2016
KR 101717619 B1 3/2017

OTHER PUBLICATIONS

International Search Report and Written Opinion; PCT Application No. PCT/US2019/040034; dated Mar. 31, 2020.
English abstract of KR101717619; retrieved from www.espacenet.com on Jul. 7, 2021.
English abstract of CN205561050; retrieved from www.espacenet.com on Jul. 7, 2021.

* cited by examiner

*Primary Examiner* — Brad Harcourt
(74) *Attorney, Agent, or Firm* — Polsinelli PC

(57) ABSTRACT

A desiccating module configured to be installed in a downhole tool is provided. The desiccating module includes a housing having a containment portion, and desiccant located in the containment portion of the housing capable of retaining moisture therein. The housing is configured to be retained in a downhole tool containing moisture sensitive electronics. The housing is configured to permit passage of moisture from outside the housing to the containment portion and to retain the desiccant within the containment portion. The desiccant have a retention capacity sufficient to hold a predetermined threshold amount of moisture.

20 Claims, 8 Drawing Sheets

DESICCATING MODULE TO REDUCE MOISTURE IN DOWNHOLE TOOLS

FIELD

The present disclosure relates generally to downhole tools with electronic components. In at least one example, the present disclosure relates to reducing moisture in downhole tools with electronic components to improve reliability of the electronic components.

BACKGROUND

Wellbores are drilled into the earth for a variety of purposes including accessing hydrocarbon bearing formations. A variety of downhole tools may be used within a wellbore in connection with accessing and extracting such hydrocarbons. The downhole tools may include electronic components which are sensitive to moisture. Moisture in the downhole tools may decrease reliability of the electronic components.

BRIEF DESCRIPTION OF THE DRAWINGS

Implementations of the present technology will now be described, by way of example only, with reference to the attached figures, wherein.

DETAILED DESCRIPTION

Figure 1A:
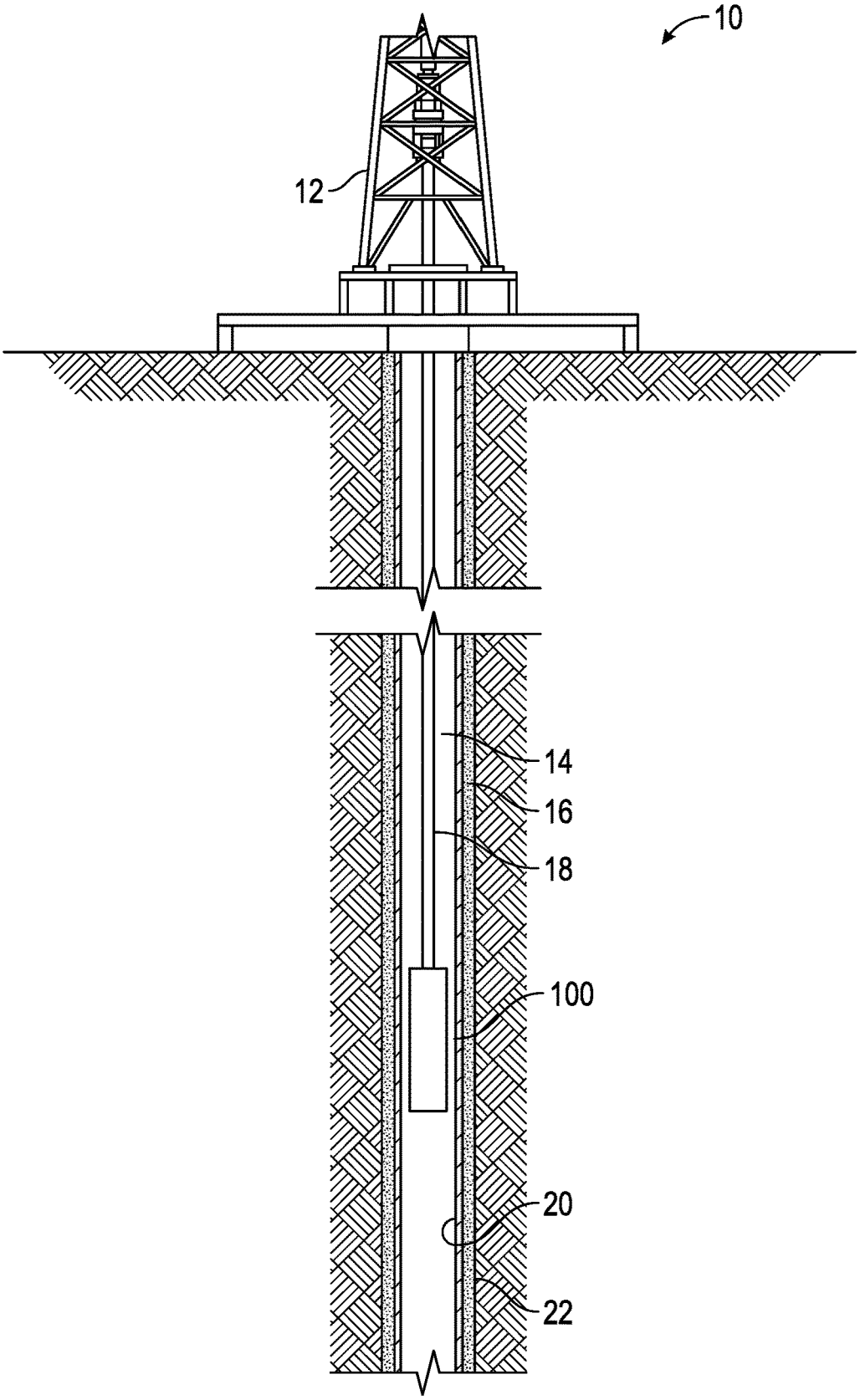
FIG. 1A is a diagram illustrating an exemplary environment for a downhole tool according to the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Disclosed herein is a desiccating module to be disposed in a downhole tool to reduce moisture in the downhole tool. The combination of high temperature and high humidity has negative effects on the reliability of electronic components. Conventionally, bake out is used to control the moisture, where the electronic component is subject to high temperatures to evaporate the moisture. Bake out refers to the process of using high heat to remove moisture, for example evaporation, from the components within the downhole tool prior to closing and sealing the downhole tool. Accordingly, the moisture within the downhole tool is minimized. Bake out can be utilized in conjunction with, or separately, from creating a vacuum and/or filling the downhole tool with an inert gas to remove any moisture in the downhole tool. However, bake out of electronic components can take several hours and requires an oven capable of heating up the entire electronics assembly. Accordingly, bake out can be timely and requires expensive and bulky equipment.

A desiccating module can be inexpensive and easy to replace in the downhole tools without using special tools or equipment. A desiccating module includes a housing operable to contain molecular sieve desiccants. In at least one example, the desiccants can be molecular sieve desiccants. Molecular sieve desiccants provide advantageous benefits based on technical performance characteristics and ability to adsorb moisture, for example water vapor, and contain it at temperatures, for example as high as 350 degrees Fahrenheit.

Molecular sieve desiccants can include synthetic porous crystalline aluminosilicates (artificial clays) which have been engineered to have a very strong affinity for specifically sized molecules. The definitive feature of the molecular sieve structure, as compared to other desiccant media, is the uniformity of the pore size openings. The pore size can be, for example, between about 3 angstroms and about 10 angstroms. For example, desiccants can have a pore size of about 4 angstroms (4 A), while 3 angstroms (3 A), 5 angstroms (5 A) and 10 angstroms (13 X) are also available. This distinctive feature allows for the selection of a molecular sieve product which can adsorb water vapor yet exclude most other molecules such as volatile organic compounds (VOCs) which may or may not be present in the package. Additionally, the composition of molecular sieve desiccants allows for the desiccant to be reused and withstand the environment in a wellbore.

The desiccating module can be installed in downhole tools before sealing the downhole tool and replaced each time the downhole tool is opened for service. The desiccants and/or the housing may vary in shape, size, and composition in order to capture different chemicals/fluids and/or fit in receiving portions in downhole tools that have differing sizes and shapes. For example, the housing can be created by sintering and/or three-dimensional printing to customize the size, shape, and moisture passage patterns needed to fit in the receiving portion of the downhole tool.

The desiccating module can be employed in an exemplary wellbore system 10 shown, for example, in FIG. 1A. A system 10 for anchoring a downhole tool 100 in a wellbore 14 includes a drilling rig 12 extending over and around the wellbore 14. The wellbore 14 is within an earth formation 22 and has a casing 20 lining the wellbore 14, the casing 20 is held into place by cement 16. A downhole tool 100 can be disposed within the wellbore 14 and moved up and/or down the wellbore 14 via a conduit 18 to a desired location. The downhole tool 100 can include, for example, downhole sensors, chokes, and/or valves. In some examples, the downhole tool 100 can include a drillbit to drill and/or mill the wellbore 14 in the formation 22. In at least one example, the downhole tool 100 can carry out logging and/or other operations.

The conduit 18 can be, for example, tubing-conveyed, wireline, slickline, work string, joint tubing, jointed pipe, pipeline, coiled tubing, and/or any other suitable means for conveying downhole tools 100 into a wellbore 14. In some examples, the conduit 18 can include electrical and/or fiber optic cabling for carrying out communications. The conduit 18 can be sufficiently strong and flexible to tether the downhole tool 100 through the wellbore 14, while also permitting communication through the conduit 18 to one or more of the processors, which can include local and/or remote processors. Moreover, power can be supplied via the conduit 18 to meet power requirements of the downhole tool 100. For slickline or coiled tubing configurations, power can be supplied downhole with a battery or via a downhole generator.

Figure 1B:
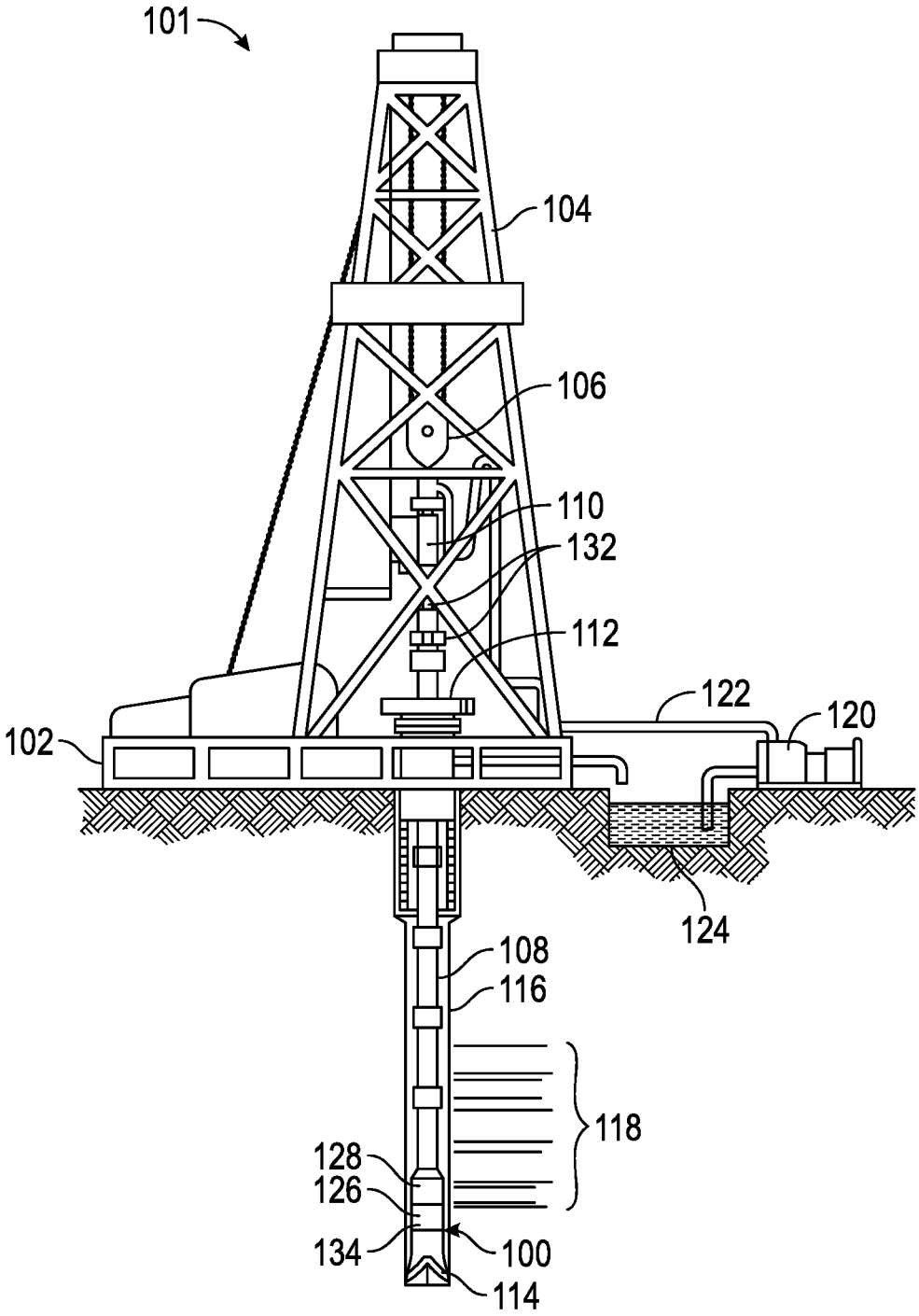
FIG. 1B is a diagram illustrating another exemplary environment for a downhole tool according to the present disclosure.

FIG. 1B illustrates a schematic view of a Logging-While-Drilling (LWD) wellbore operating environment 101 in accordance with some examples of the present disclosure. Logging-While-Drilling typically incorporates sensors that acquire formation data. The drilling arrangement of FIG. 1B also exemplifies what is referred to as Measurement While Drilling (commonly abbreviated as MWD) which utilizes sensors to acquire data from which the wellbore's path and position in three-dimensional space can be determined.

As depicted in FIG. 1B, a drilling platform 102 can be equipped with a derrick 104 that supports a hoist 106 for raising and lowering a conduit 108. The conduit 108 can be, for example, tubing-conveyed, wireline, slickline, work string, joint tubing, jointed pipe, pipeline, coiled tubing, and/or any other suitable means for conveying downhole tools 100 into a wellbore 116. The hoist 106 suspends a top drive 110 suitable for rotating and lowering the conduit 108 through a well head 112. A downhole tool 100, such as a bottom-hole assembly, can be connected to the lower end of the conduit 108. The bottom-hole assembly 100 can include a drill bit 114. As the drill bit 114 rotates, the drill bit 114 creates a wellbore 116 that passes through various subterranean formations 118. A pump 120 circulates drilling fluid through a supply pipe 122 to top drive 110, down through the interior of drill string 108 and orifices in drill bit 114, back to the surface via the annulus around conduit 108, and into a retention pit 124. The drilling fluid transports cuttings from the wellbore 116 into the retention pit 124 and aids in maintaining the integrity of the wellbore 116. Various materials can be used for drilling fluid, including oil-based fluids and water-based fluids.

Logging tools 126 can be integrated into the bottom-hole assembly 100 near the drill bit 114. As the drill bit 114 extends the wellbore 116 through the formations 118, logging tools 126 collect measurements relating to various formation properties as well as the orientation of the tool and various other drilling conditions. The bottom-hole assembly 100 may also include a telemetry sub 128 to transfer measurement data to a surface receiver 132 and to receive commands from the surface. In some examples, the telemetry sub 128 communicates with a surface receiver 132 using mud pulse telemetry. In some examples, the telemetry sub 128 does not communicate with the surface, but rather stores logging data for later retrieval at the surface when the logging assembly is recovered.

Each of the logging tools 126 may include one or more tool components spaced apart from each other and communicatively coupled by one or more wires and/or other media. The logging tools 126 may also include one or more computing devices communicatively coupled with one or more of the tool components by one or more wires and/or other media. The one or more computing devices may be configured to control or monitor a performance of the tool, process logging data, and/or carry out one or more aspects of the methods and processes of the present disclosure.

In at least one example, one or more of the logging tools 126 may communicate with a surface receiver 132 by a wire, such as wired drillpipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drillpipe.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

It should be noted that while FIGS. 1A and 1B generally depict land-based operations, those skilled in the art would readily recognize that the principles described herein are equally applicable to operations that employ floating or sea-based platforms and rigs, without departing from the scope of the disclosure. Also, even though FIGS. 1A and 1B depict vertical wellbores, the present disclosure is equally well-suited for use in wellbores having other orientations, including horizontal wellbores, slanted wellbores, multilateral wellbores or the like. Further, the wellbore system 10 can have a casing already implemented while, in other examples, the system 10 can also be used in open hole applications.

Figure 2A:
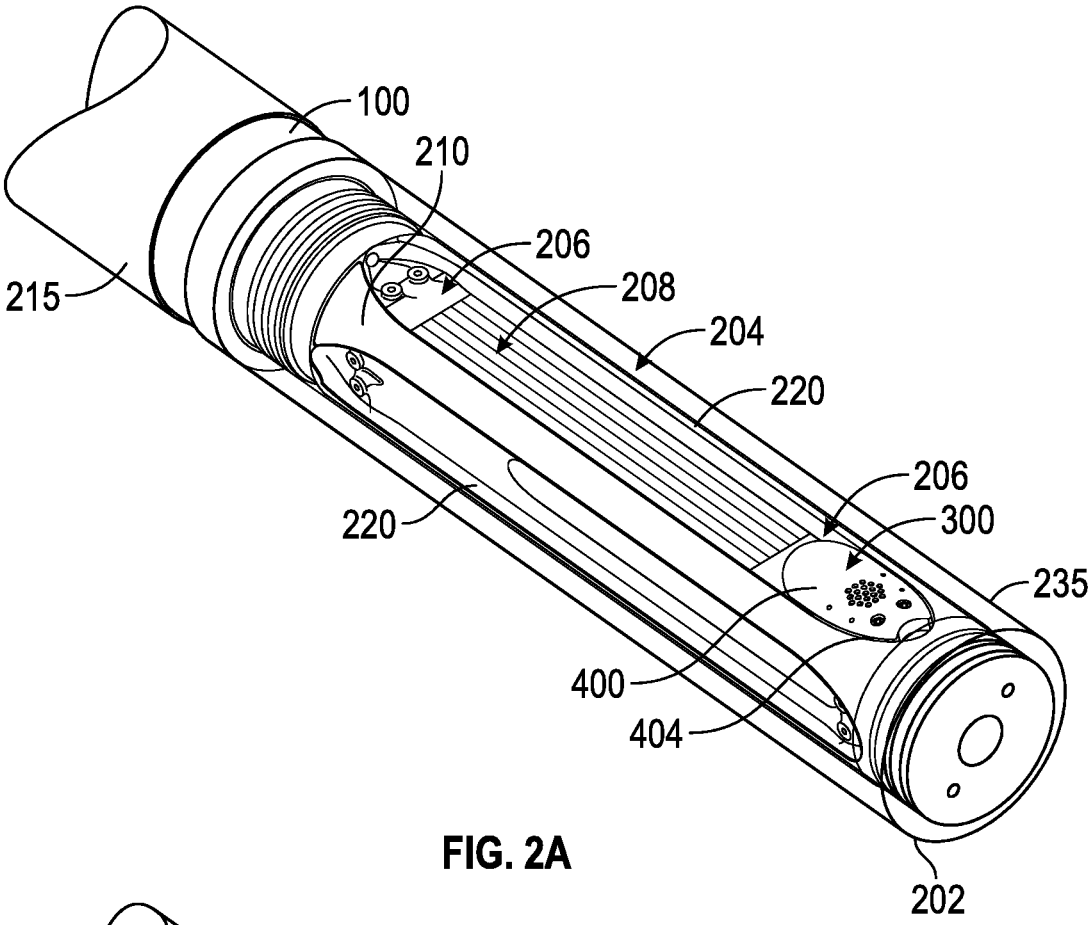
FIG. 2A is a diagram illustrating an exemplary downhole tool.
Figure 2B:
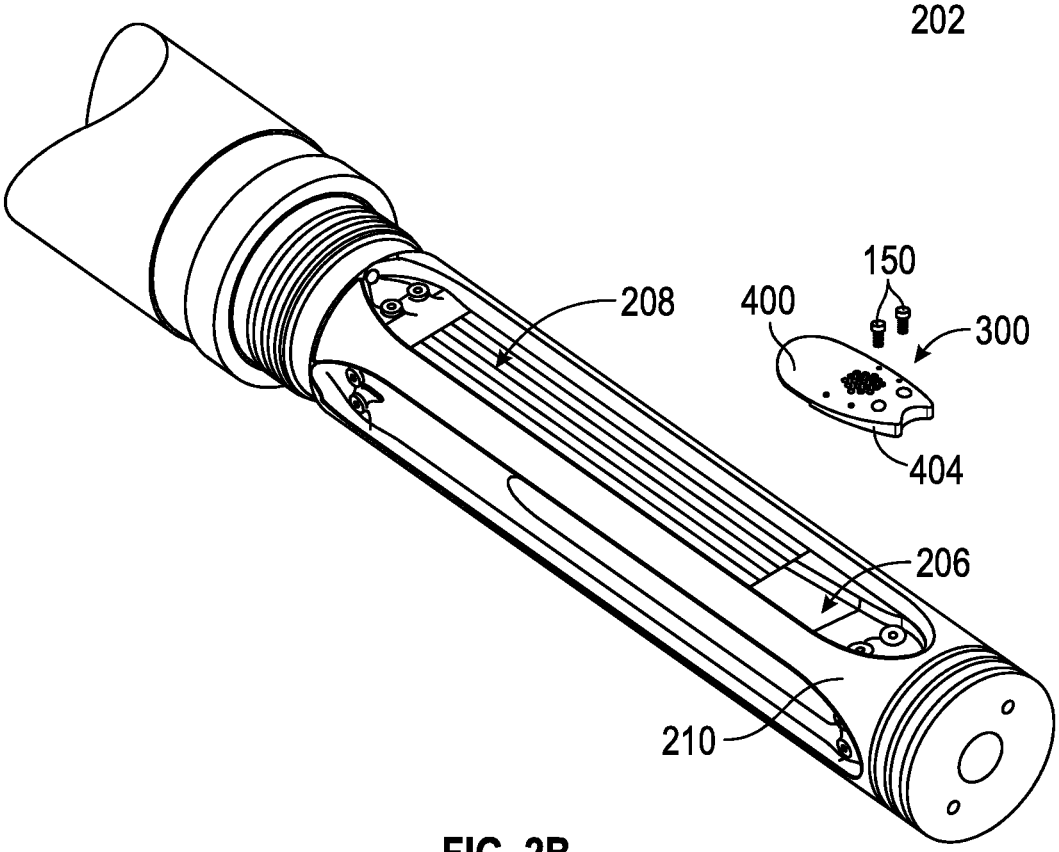
FIG. 2B is an exploded view of the downhole tool of FIG. 2A, omitting the enclosure.

FIGS. 2A and 2B are diagrams of an exemplary segment of a downhole tool 100, for example, the downhole tool 100 of FIG. 1A or the downhole tool 100 of FIG. 1B. FIG. 2A illustrates the assembled downhole tool 100, and FIG. 2B illustrates the downhole tool 100 with a desiccating module 300 exploded out and omitting an enclosure 202. In some examples, the downhole tool 100 can be any other object lowered into a wellbore, for example a sensor to be disposed within a wellbore. The portion of the downhole tool 100 may be or include one of the logging tools 126 of FIG. 1B, a sensor collar, an electronics collar, or any other portion of a downhole tool 100.

The downhole tool 100 as shown in FIGS. 2A and 2B includes a first portion 210 with a shorter diameter than a second portion 215 of the downhole tool 100. In some examples, the first portion 210 and the second portion 215 of the downhole tool 100 have substantially the same diameters.

The first portion 210 of the downhole tool 100 includes one or more pockets 220 configured to receive one or more electronic components 208, for example moisture sensitive electronics. The electronic component 208 can be configured to perform processing of data and communicate with the downhole tool 100. In operation, the electronic component 208 can communicate with one or more components and may also be configured to communicate with remote devices/systems. While FIGS. 2A and 2B illustrate one electronic component 208, the downhole tool 100 can include two, three, or more electronic components 208 to control the function and/or communication for the downhole tool 100. In some examples, other components such as valves, pumps, motors, and/or sensors can be included in the downhole tool 100. In some examples, the other components can be communicatively coupled with the electronic component 208.

An enclosure 202, as shown transparently in FIG. 2A, may surround the first portion 210 of the downhole tool 205 and any installed assemblies housing tool components. In at least one example, the enclosure 202 can be a pressure sleeve and/or an outer tube. The enclosure 202 may further secure the component modules (e.g., electronic component 208) in place within the pocket of the first portion 210 of the downhole tool 100 as well as provide additional protection to the component modules. In some examples, the enclosure 202 may be configured such that the enclosure 202 provides additional strength and stability to the downhole tool 100.

When the enclosure 202 is closed and/or sealed, the enclosure 202 of the downhole tool 100 forms an annulus 204, and the annulus 204 and any components of the first portion 210 within the annulus 204 are not exposed to the outside environment. When closed, the enclosure 202 can form a seal to prevent fluid communication with the environment outside of the enclosure 202. In some examples, the enclosure 202 can form a seal using o-rings, gaskets, and/or any other suitable sealing components. The enclosure 202 can be open and closed as needed, for example to repair, replace, and/or exchange any components within the enclosure 202.

The enclosure 202 of the downhole tool 100 can be made, for example, out of material including steel, metal alloy, and/or any other suitable material to withstand a predetermined threshold temperature, for example the environment of a wellbore 14, such as example pressure, temperature, and/or external forces. For example, the temperature within a wellbore 14 can be as high as about 350 degrees Fahrenheit. Accordingly, the predetermined threshold temperature can be up to about 350 degrees Fahrenheit.

Before the enclosure 202 is closed and sealed, moisture from the atmosphere can enter the annulus 204. In some examples, moisture can be from fluids external and/or internal of the downhole tool 100. For examples, moisture can include water vapor from the atmosphere and/or hydrocarbons from the wellbore 14. Accordingly, when the enclosure 202 is closed and/or sealed, the moisture is trapped within the downhole tool 100, and components in the downhole tool 100, such as the electronic component 208, can be exposed to the moisture present within the downhole tool 100. The moisture can have a negative effect on the reliability and/or functionality of the electronic component 208. In some examples, high temperature, for example the temperatures within the wellbore such as 350 degrees Fahrenheit, combined with high humidity from the moisture can negatively impact the electronic component 208. When the enclosure 202 is sealed, the first portion 210 and the annulus 204 are not substantially exposed to any additional moisture or fluids than those entrapped in the annulus 204.

Within the enclosure 202, the annulus 204 includes a receiving portion 206 which can receive a desiccating module 300 (as discussed below in FIGS. 3A-4D) to adsorb the moisture within the enclosure 202. For example, the desiccating module 300 can adsorb the moisture such that the amount of moisture within the downhole tool 100 is below a predetermined threshold. The predetermined threshold is determined such that the moisture does not negatively affect the functionality and/or reliability of the electronic component 208 and/or any other component within the downhole tool 100. For example, the predetermined threshold may be about 25% relative humidity. In some examples, the predetermined threshold may be about 10% relative humidity. In some examples, the predetermined threshold may be about 5% relative humidity. In some examples, the predetermined threshold may be about 2% relative humidity. In some examples, the desired relative humidity may be between 0% and about 25%. In some examples, the desired relative humidity may be between about 2% and about 25%.

The receiving portion 206 can be any portion of the annulus 204 which does not have any components of the downhole tool 100. The receiving portion 206 can receive the desiccating module 300 such that the desiccating module 300 does not interfere with and/or damage the components of the downhole tool 100. The receiving portion 206 is in fluid communication with the rest of the annulus 204, such that moisture in the annulus 204 can flow to the receiving portion 206. For example, as illustrated in FIGS. 2A and 2B, the receiving portion 206 is adjacent to and/or is a portion of the pocket 220. In other examples, the receiving portion 206 can be located in any other position within the first portion 210 of the downhole tool 100 and enclosed within the enclosure 202 so long as the receiving portion 206 is in fluid communication with the electronic components 208. In at least one example, the receiving portion 206 can be at least partially separated from the rest of the annulus 204 by one or more walls. In some examples, the receiving portion 206 can be an open space within the annulus 204. While FIGS. 2A and 2B illustrate the receiving portion 206 being at an end of the downhole tool 100, the receiving portion 206 can be any space in the enclosure 202 that can receive the desiccating module 300.

As illustrated in FIG. 2B, the desiccating module 300 can be coupled with the first portion 210 by fasteners 150 to restrict movement of the desiccating module 300 within the downhole tool 100. In some examples, the desiccating module 300 can be removably received within the downhole tool 100. By being removably received and/or coupled with the downhole tool 100, the desiccating module 300 can be easily removed and replaced without the need to replace the entire downhole tool 100 and/or the first portion 210 of the downhole tool 100. Accordingly, a new desiccating module 300 can be inserted after removal of the used desiccating module 300. Additionally, the used desiccating module 300 can have the captured moisture removed, and is ready to be reinserted into the same or another downhole tool 100. As illustrated in FIG. 2B, the fasteners 150 can include screws. In some examples, the fasteners 150 can include bolts, nails, adhesives, or any other suitable fastener 150 to restrict the movement of the desiccating module 300.

In some examples, the desiccating module 300 can be received in the receiving portion 206 by friction fit. For example, as illustrated in FIGS. 2A, 2B, 4C, and 4D, the desiccating module 300 can include a seat 404 configured for friction-fit, mating engagement within a complementarily configured receiving portion 206 of the downhole tool 100. The seat 404 can be shaped, sized, and be made of such material so that the seat 404 may at least partially deform to squeeze into at least a part of the receiving portion 206. In some examples, when past the part of the receiving portion 206, the seat 404 may expand such that the seat 404 is friction-fit and matingly engaged within the receiving portion 206 of the downhole tool 100. In some examples, the seat 404 may not expand, and the pressure of the seat 404 against the receiving portion 206 creates the friction-fit. With the housing 202 of the desiccating module 300 being removably received by the downhole tool 100 using friction-fit, the desiccating module 300 can easily be removed and/or securely placed without the need of any extra tools, special tools, and/or expertise.

As illustrated in FIGS. 2A and 2B, the receiving portion 206 is provided on the surface of the first portion 210 of the downhole tool 100. In some examples, the receiving portion 206 can be within a compartment of the first portion 210. As illustrated in FIGS. 2A and 2B, the first portion 210 of the downhole tool 100 includes two receiving portions 206, and a desiccating module 300 received in one of the receiving portions 206. In other examples, one, two, three, or more receiving portions 206 can be included in the first portion 210, and any corresponding number of desiccating modules 300 can be included. The number of desiccating modules 300 disposed within the first portion 210 can be determined by the amount of moisture that may be present within the annulus 204 after the enclosure 202 is closed and sealed.

Figure 3A:
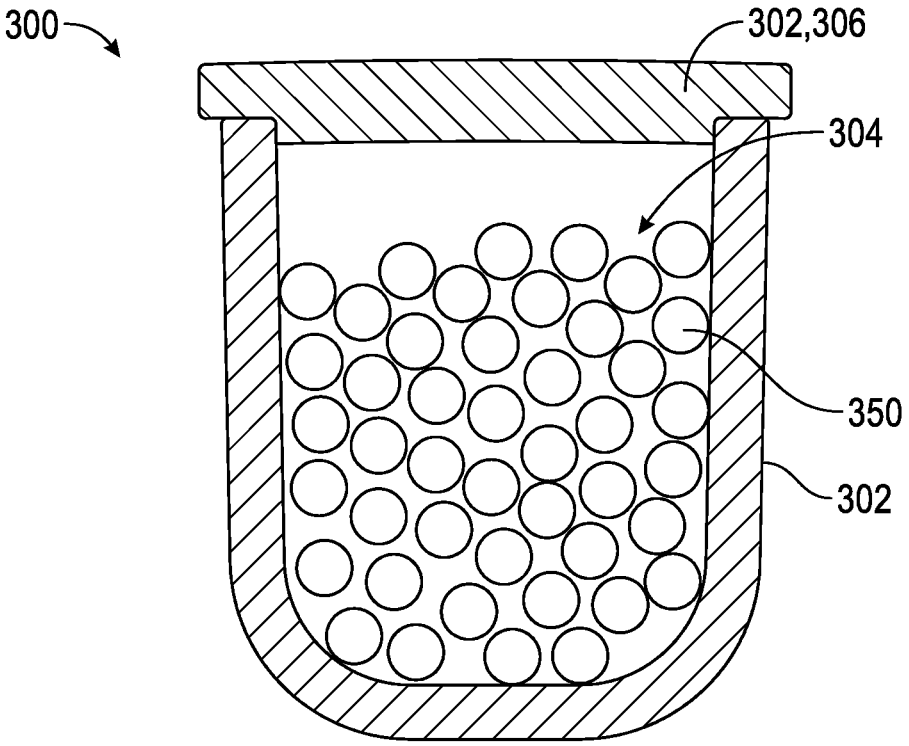
FIG. 3A is a diagram illustrating a cross-sectional view of an exemplary desiccating module to reduce moisture in a downhole tool.
Figure 3B:
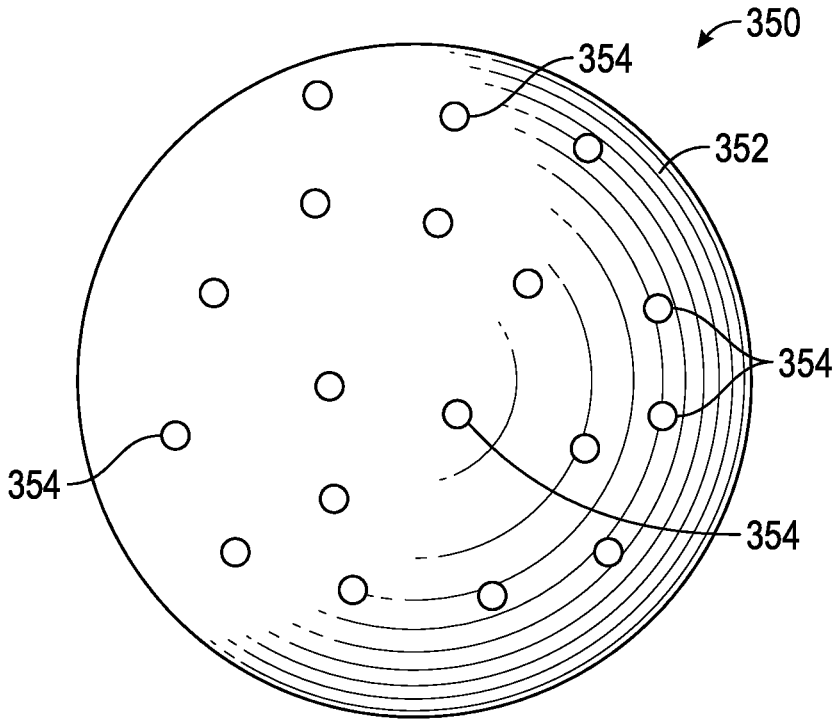
FIG. 3B is a diagram illustrating an exemplary desiccant as shown in FIG. 3A.
Figure 3C:
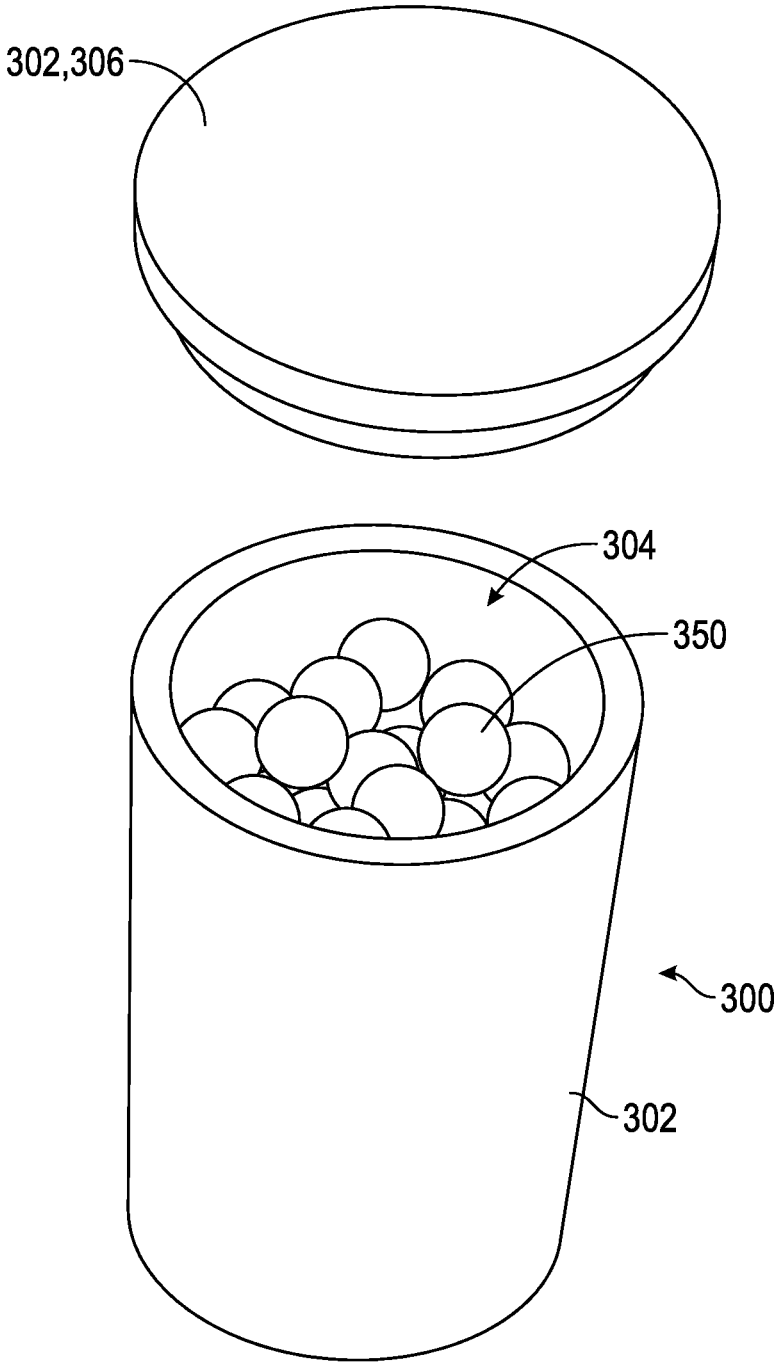
FIG. 3C is a diagram illustrating a perspective view of the desiccating module as shown in FIG. 3A.

FIGS. 3A-3C illustrate an example of a desiccating module 300 operable to reduce moisture in downhole tools 100. FIG. 3A illustrates a cross-sectional view of the desiccating module 300 which includes a housing 302 having a containment portion 304. One or more desiccants 350 are disposed in the containment portion 304 of the housing 302 to adsorb moisture and at least reduce the amount of moisture in the downhole tool 100. FIG. 3B illustrates an example of a desiccant 350. FIG. 3C illustrates a perspective view of the desiccating module 300, for example as shown in FIG. 3A.

The housing 302 is operable to be contained within a downhole tool 100, for example as illustrated in FIGS. 2A-2B. The housing 302 can be removably received within the downhole tool 100. Accordingly, the desiccating module 300 can be installed in the first portion 210 of the downhole tool 100 before sealing the enclosure 202 and replaced each time the downhole tool 100 is opened for servicing.

In some examples, the housing 302 may fit within the receiving portion 206, and be contained by the other components in the downhole tool 100 and the enclosure 202 of the downhole tool 100. In some examples, the housing 302 may have couplers and/or fasteners which correspond to couples and/or fasteners in the downhole tool 100 to affix the housing 302 in the receiving portion 206. In some examples, the housing 302 may be affixed in the receiving portion 206 by friction fit. In some examples, the housing 302 may be moveable within the receiving portion 206, for example such that the housing 302 may rotate, shift, and/or tilt within the receiving portion 206.

As illustrated in FIGS. 3A and 3C, the housing 302 may be substantially cylindrical in shape. In other examples, the housing 302 may be a rectangular prism, ovoid, pyramid, irregular and/or any other suitable shape to fit within the receiving portion 206 of the downhole tool 100. A cap 306 can be included to fit over the opening of the housing 302 to contain the desiccants 350 in the containment portion 304. The cap 306 closes and seals the housing 302 of the desiccating module 300. Accordingly, undesired fluid cannot access the containment portion 304 of the housing 302, and subsequently the desiccants 350. Additionally, any fragments of the desiccants 350 are not undesirably released from the housing 302. As illustrated in FIGS. 3A and 3C, the cap 306 can be set in place and removable by friction fit. In some examples, the cap 306 may be hinged, threaded, and/or adhered to the housing 302. In some examples, the housing 302 may not include a cap 306, and the desiccants 350 may be sealed within the housing 302. Accordingly, the housing 302 may not inadvertently open and release the desiccants 350 while being subjected to the vibrations and/or forces within a wellbore.

FIG. 3B illustrates an example of a desiccant 350 which is disposed in the containment portion 304 of the housing 302. The desiccants 350 are operable to adsorb the moisture in the annulus 204 of the downhole tool 100 such that the moisture in the downhole tool 100 is below a predetermined threshold or within a predetermined range. The desiccants 350 are made of a material 352 and have pores 354 to adsorb the moisture. Accordingly, the moisture is adhered to the material 352 and held and/or trapped in the pores 354. As illustrated in FIG. 3B, the desiccant 350 is substantially circular with substantially circular pores 354. In other examples, the desiccant 350 and/or the desiccant pores 354 can have any other suitable shape.

The number and/or type of desiccant 350 to be disposed in the containment portion 304 may be determined by calculating the amount and/or type of estimated moisture present in the annulus 204 of the downhole tool 100 when the enclosure 202 is closed and/or sealed. For example, the moisture may include water vapor, hydrocarbons, and/or any other fluid. The type of desiccant 350, for example the diameter, pore size, and/or composition, may vary based on the different chemical or fluid in the moisture to be captured. In some examples, the desiccants 350 may include artificial clay. The desiccants 350 can have a retention capacity sufficient to hold a predetermined threshold amount of moisture at a predetermined threshold temperature. For example, the temperatures within the wellbore 14 can be about 350 degrees Fahrenheit. Accordingly, the desiccants 350 may hold the moisture up to the predetermined threshold temperature of up to about 350 degrees Fahrenheit. In some examples, the desiccants 350 may have pores 354 with pore sizes of about 3 angstroms to about 10 angstroms to adsorb the moisture. In other examples, the desiccants 350 may have pores 354 with pore sizes of about 4 angstroms. By reducing and/or removing the moisture in the downhole tool 100 by adsorption due to the desiccants 350, there is no need to bake out the electronic component 208. Additionally, the reduction and/or removal of the moisture increases the reliability and life of the downhole tool 100.

The housing 302 of the desiccating module 300 can be made of a material such that the moisture in the downhole tool 100 traverses the housing 302 from external the housing 302 to the containment portion 304. The housing 302 can include passages, such as pores, through one or more of the walls of the containment portion 304. The passages can be configured to permit passage of moisture from outside the housing 302 to inside the housing 304. Additionally, the housing 302 encloses the desiccants 350 as well as any fragments of the desiccants 350 that may be broken off, for example by vibration. The housing 302 can be made of a porous material to permit the traversal of the moisture in the downhole tool 100 to the containment portion 304 and retain the desiccants 350 and/or any fragments of the desiccants 350 within the containment portion 304. For example, the housing 302 can have a density as low as 45% and/or a pore size between about 10 microns and about 100 microns in range. For example, the housing 302 can include stainless steel. In other examples, the housing 302 can include aluminum and/or titanium. In at least one example, the housing 302 and/or the cover 400 is non-magnetic so as not to interfere with the electronic component 208, for example a sensor measuring magnetic fields. For example, the housing 302 can include stainless steel 316 as the material can have pores of the desired size as well as have non-magnetic properties. The material of the housing 302 is operable to contain the desiccants 350 as well as withstand high temperature (for example up to at least 350 degrees Fahrenheit in the wellbore) and vibration while providing communication between the desiccants 350 and the air volume in the downhole tool 100.

In some examples, the housing 302 may be created by sintering or three-dimensional (3D) printing to form the desired shape. For example, the available receiving portions 206 in different downhole tools 100 may have different shapes and/or sizes. Accordingly, by forming the housing 302 with 3D printing, the shape of the housing 302 can be customized to fit within each receiving portion 206.

In at least one example, the desiccating module 300 can be reusable. For example, the desiccating module 300 can be reheated above activation temperature, such as about 200 degrees Celsius. When the desiccating module 300 is reheated above activation temperature, the moisture can be released, and then the desiccating module 300 can be installed into a downhole tool 100 to be used once again.

Figure 3D:
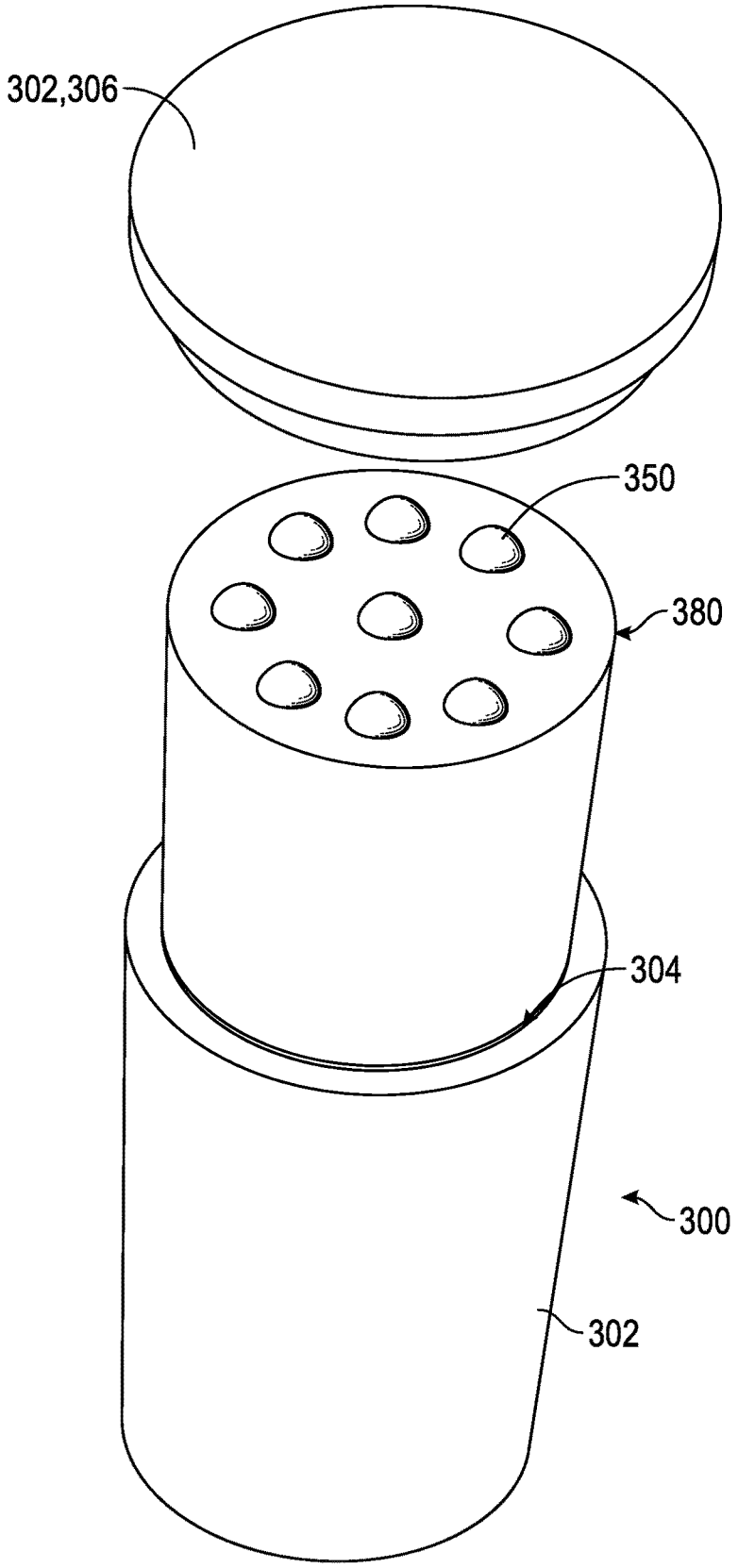
FIG. 3D is a diagram illustrating an exemplary desiccant module including a retention component.

FIG. 3D illustrates a desiccating module 300, such as the desiccating module 300 described above for FIGS. 3A-3C. As illustrated in FIG. 3D, the desiccating module 300 can include a retaining component 380. The retaining component 380 can be operable to at least restrict movement of the desiccants 350 within the housing 302. By restricting movement of the desiccants 350 in the housing 302, fragmentation of the desiccants 350 may be reduced. By being disposed down a wellbore, the downhole tool 100 and the desiccating module 300 would be subject to extreme conditions, such as vibration and/or impact forces. If movement of the desiccants 350 is not restricted, the desiccants 350 may break, and in some examples may be pulverized. Accordingly, if the desiccants 350 do not collide and impact with other desiccants 350 and/or the housing 302, the desiccants 350 may not break and could be reused. In some examples, the retaining component 380 can be porous and/or have passages such that the desiccants 350 are in communication with the fluid and/or moisture.

In some examples, the retaining component 380, for example as illustrated in FIG. 3D, the retaining component 380 can include a material which encapsulates at least a portion of the desiccants 350. For example, the retaining component 380 can include fluid, gel, sponge, foam, and/or any other suitable material which can encapsulate at least a portion of the desiccants 350 and permit fluid and/or moisture to reach the desiccants 350. In at least one example, the desiccants 350 can be encapsulated within the retaining component 380 prior to disposing the desiccants 350 in the housing 302. In other examples, the desiccants 350 can be disposed in the housing 302, and then the retaining component 380 is thereafter disposed within the housing 302. In some examples, the retaining component 380 can be injected into the housing 302. For example, the retaining component 380 can include open cell foam.

While FIG. 3D illustrates the desiccants 350 at least partially encapsulated within the retaining component 380, in some examples, the retaining component 380 can be positioned around, above, and/or below the desiccants 350 within the housing 302. For example, the desiccants 350 can be disposed in the housing 302, and the retaining component 380 can be inserted into the housing to fill up any large voids to reduce movement of the desiccants 350 prior to closing and sealing the housing 302. In some examples, the retaining component 380 can be a cushioned material disposed at least partially along the inside of the housing 302 to cushion any impact of the desiccants 350 against the housing 302.

FIGS. 4A-4D illustrate another design of a desiccating module 300. The desiccating module 300, as illustrated in FIGS. 4A-4D, includes a desiccant capsule 450 (shown in FIGS. 4C and 4D) and a cover 400. The desiccant capsule 450 includes the desiccants 350. The cover 400 retains the desiccant capsule 450 such that movement of the desiccant capsule 450 is restricted. Additionally, the cover 400 can protect the desiccant capsule 450 such that the desiccant capsule 450 may not be damaged and release the desiccants 350. The cover 400, as illustrated in FIGS. 4A-4D, has an arced shape. The shape of the cover 400 can be any other suitable shape such as rectangular, oval, triangular, and/or irregular, so long as the cover 400 can be received in the downhole tool 100.

The cover 400 forms vents 410 through which fluid and moisture can pass through. The size of the vents 410 are large enough to permit the desired fluid to pass through the cover 400 to the desiccant capsule 450. In some examples, the size of the vents 410 can be small enough such that the desiccants 350, or fractions of broken desiccants 350, cannot pass through. The cover 400 also forms fastener apertures 414 through which fasteners 150 (for example as illustrated in FIG. 2C) can pass to secure the cover 400 in the downhole tool 100.

Figure 4A:
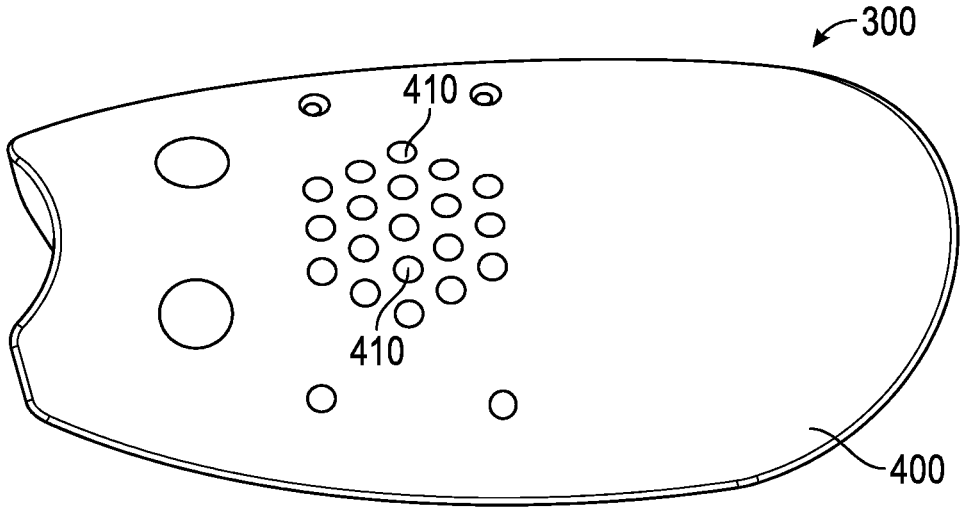
FIG. 4A is a diagram illustrating an exemplary desiccating module to reduce moisture in a downhole tool.
Figure 4B:
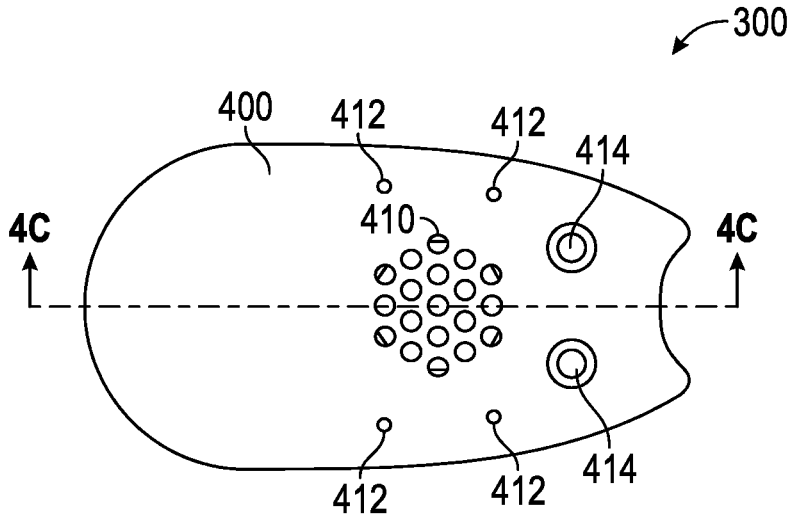
FIG. 4B is a top view of the desiccating module of FIG. 4A.
Figure 4C:
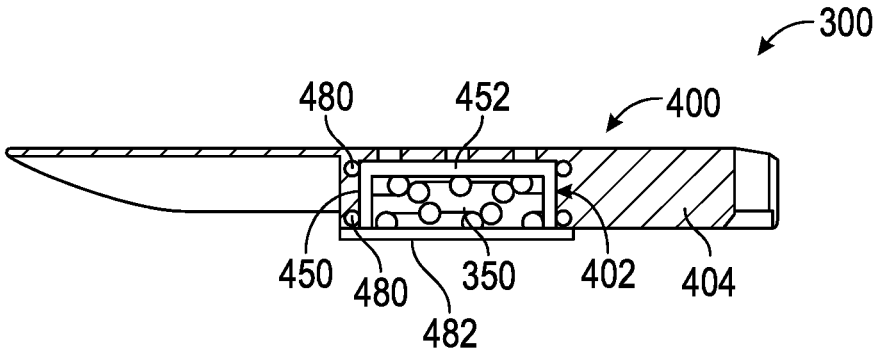
FIG. 4C is a cross-sectional view of FIG. 4B, taken along line 4C-4C.

As shown in FIG. 4C, the cover 400 includes a capsule portion 402 which is sized and shaped to receive the desiccant capsule 450. The desiccant capsule 450 includes a housing 452 which can have similar properties and features as housing 302 of the desiccating module 300 as discussed above for FIGS. 3A-3D.

As illustrated in FIG. 4C, the housing 452 of the desiccant capsule 450 may enclose all but one side of the desiccant capsule 450. Accordingly, the desiccant capsule 450 is closed and sealed by abutment against a receiving plate 482, the downhole tool 100, and/or securing components 480.

In some examples, the housing 452 of the desiccant capsule 450 can fully enclose the desiccants 350, such as the housing 302 discussed above for FIGS. 3A-3D. Additionally, in at least one example, the desiccant capsule 450 can include a retaining component 480, for example as discussed above for FIG. 3D.

Figure 4D:
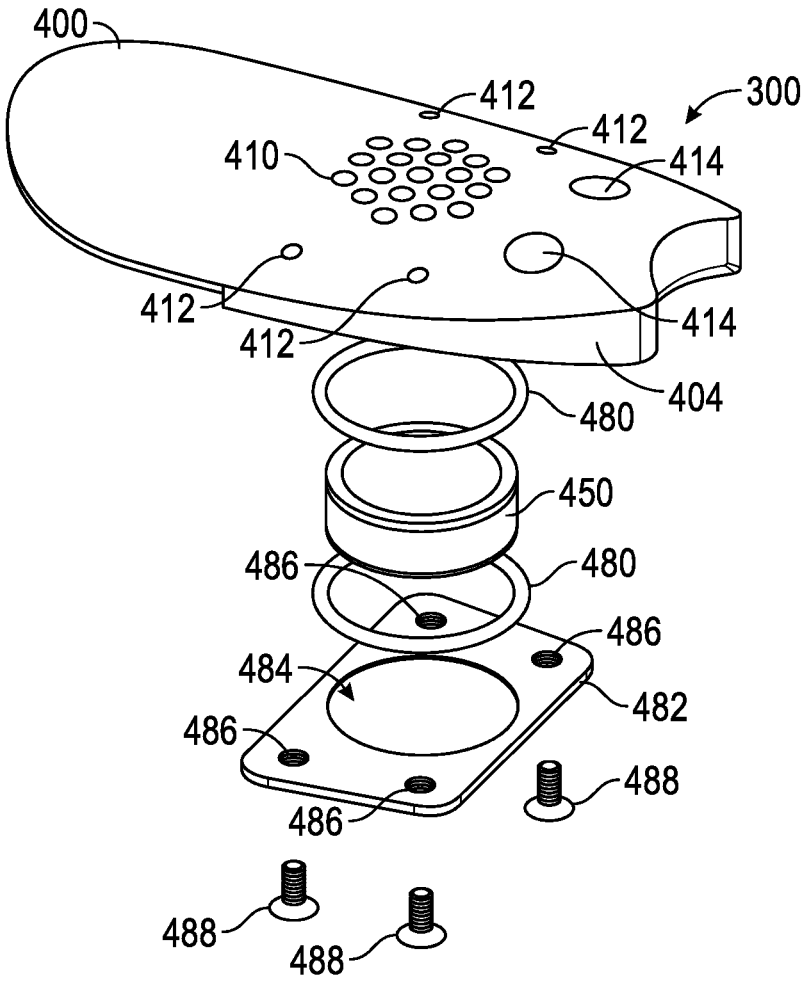
FIG. 4D is an exploded view of the desiccating module of FIG. 4A.

As illustrated in FIG. 4D, the desiccating module 300 can additionally include a receiving plate 482. The receiving plate 482 can form a receiving portion 484 shaped and sized to receive at least a portion of the desiccant capsule 450. The receiving portion 484 can restrict the movement of the desiccant capsule 450. The desiccant capsule 450 can be removably received in the receiving portion 484. In some examples, the receiving portion 484 can include a recessed portion sized and shaped to correspond with the desiccating module 300. In some examples, the receiving portion 484 can form an aperture such that the desiccating module 300 abuts against the downhole tool 100.

Securing components 480 can be included to secure the position of the desiccant capsule 450. For example, as illustrated in FIG. 4D, two securing components 480 can be provided, one on either side of the desiccant capsule 450. The securing components 480 can restrict movement of the desiccant capsule 450. In some examples, the securing components 480 create a seal between the desiccant capsule 450 and the cover 400 and the receiving plate 482 such that fluid does not cross the seal of the securing components 480. FIGS. 4C and 4D illustrate a securing component 480 between the desiccant capsule 450 and the cover 400 and another securing component 480 between the desiccant capsule 450 and the receiving plate 482. In some examples, only one of the securing components 480 may be included. In some examples, securing components 480 are not included.

The receiving plate 482 can be coupled to the cover 400 by couplers 488. As illustrated in FIG. 4D, the couplers 488 can include screws, but in some examples, the couplers 488 can include nails, nuts and bolts, adhesives, and/or any other suitable coupler to couple the cover 400 with the receiving plate 482. The couplers 488 can pass through the coupler apertures 486 in the receiving plate 482 and through the coupler apertures 412 in the cover 400.

Figure 5:
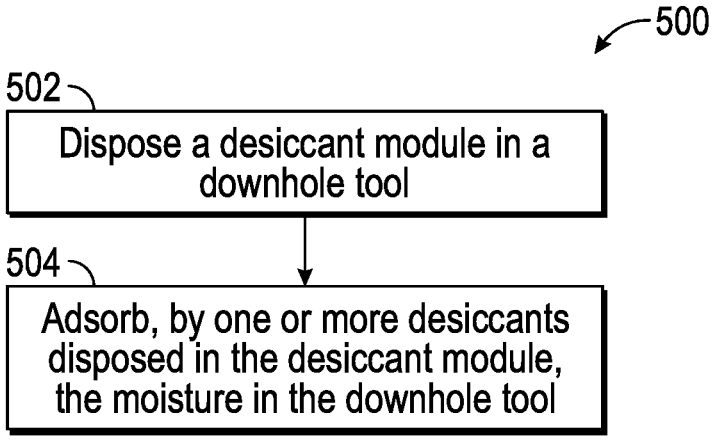
FIG. 5 is a flow chart of a method for utilizing a desiccating module to reduce moisture in a downhole tool.

Referring to FIG. 5, a flowchart is presented in accordance with an example embodiment. The method 500 is provided by way of example, as there are a variety of ways to carry out the method. The method 500 described below can be carried out using the configurations illustrated in FIGS. 1-4D, for example, and various elements of these figures are referenced in explaining example method 500. Each block shown in FIG. 5 represents one or more processes, methods or subroutines, carried out in the example method 500. Furthermore, the illustrated order of blocks is illustrative only and the order of the blocks can change according to the present disclosure. Additional blocks may be added or fewer blocks may be utilized, without departing from this disclosure. The example method 500 can begin at block 502.

At block 502, a desiccating module is disposed in a downhole tool. The downhole tool contains an electronic component which is exposed to moisture present within the downhole tool. The desiccating module can include a housing having a containment portion. The housing can be operable to be contained within a receiving portion of the downhole tool, where the receiving portion can be any available space not interfering or taken up by any components of the downhole tool. One or more desiccants are disposed in the containment portion of the housing. The desiccants can have pore sizes of about 3 angstroms to about 10 angstroms to adsorb the moisture. As discussed above, the desiccants can be molecular sieve desiccants. The material and pore sizes of the desiccants can be adjusted to adsorb different moisture compositions and/or different volumes of moisture. After the desiccating module is disposed in the downhole tool, the portion of the downhole tool with the desiccating module and electronic component is sealed with an enclosure.

At block 504, moisture in the downhole tool is adsorbed by the one or more desiccants such that the moisture in the downhole tool is below a predetermined threshold. By being below the predetermined threshold, the moisture does not substantially hinder the functionality and reliability of the electronic component in the downhole tool. Accordingly, the life span of the downhole tool can be increased. The desiccants can hold the moisture up to a predetermined threshold temperature, for example temperatures within a wellbore. For example, the temperature within a wellbore can be as high as about 350 degrees Fahrenheit. Accordingly, the predetermined threshold temperature can be up to about 350 degrees Fahrenheit. The desiccant holds the moisture at those temperatures such that the adsorbed moisture is not released back into the downhole tool.

The desiccating module can be removably received in the downhole tool. For example, the desiccating module can be removed from the downhole tool, and another desiccating module can be disposed in the downhole tool to adsorb additional moisture. In some examples, the same desiccating module can be reused. For example, the desiccating module can be reheated above activation temperature, such as about 200 degrees Celsius. When the desiccating module is reheated above activation temperature, the moisture can be released, and then the desiccating module can be installed into a downhole tool to be used once again.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "adjacent" and other variants thereof are utilized to mean located close to, closer to and/or nearby, depending upon context.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Numerous examples are provided herein to enhance understanding of the present disclosure. A specific set of statements are provided as follows.

Statement 1: A desiccating module configured to be installed in a downhole tool is disclosed, the desiccating module comprising: a housing having a containment portion, the housing being configured to be retained in a downhole tool containing moisture sensitive electronics, the housing configured to permit passage of moisture from outside the housing to the containment portion and to retain the desiccant within the containment portion; and desiccant located in the containment portion of the housing capable of retaining moisture therein, the desiccant having a retention capacity sufficient to hold a predetermined threshold amount of moisture.

Statement 2: A desiccating module according to Statement 1, wherein the housing of the desiccating module further comprises a seat configured for friction-fit, mating engagement within a complementarily configured receiving portion of the downhole tool.

Statement 3: A desiccating module according to Statements 1 or 2, wherein the housing is non-magnetic.

Statement 4: A desiccating module according to any of preceding Statements 1-3, wherein the housing includes at least one of the following: stainless steel, titanium, and aluminum.

Statement 5: A desiccating module according to any of preceding Statements 1-4, wherein the desiccant includes molecular sieve.

Statement 6: A desiccating module according to any of preceding Statements 1-5, wherein the desiccant holds the predetermined threshold amount of moisture at a predetermined threshold temperature, the predetermined threshold temperature being up to about 350 degrees Fahrenheit.

Statement 7: A desiccating module according to any of preceding Statements 1-6, further comprising: a cover operable to prevent impact force against the housing, the cover forming one or more vents through which the moisture can pass through.

Statement 8: A desiccating module according to any of preceding Statements 1-7, further comprising a retaining component disposed within the containment portion, the retaining component operable to at least reduce movement of the desiccant within the containment portion.

Statement 9: A system is disclosed comprising: a downhole tool operable to be disposed within a wellbore, the downhole tool including an enclosure operable to enclose a portion of the downhole tool, the enclosure forming an annulus around the portion, the portion of the downhole tool containing moisture sensitive electronics, the moisture sensitive electronics being exposed to moisture present within the annulus; and a desiccating module contained within the enclosure, the desiccating module including: a housing having a containment portion, the housing being configured to be retained in the downhole tool containing moisture sensitive electronics, the housing configured to permit passage of moisture from outside the housing to the containment portion and to retain the desiccant within the containment portion; and desiccant located in the containment portion of the housing capable of retaining moisture therein, the desiccant having a retention capacity sufficient to hold a predetermined threshold amount of moisture.

Statement 10: A system is disclosed according to Statement 9, wherein the housing of the desiccating module further comprises a seat configured for friction-fit, mating engagement within a complementarily configured receiving portion of the downhole tool.

Statement 11: A system is disclosed according to Statements 9 or 10, wherein the housing is non-magnetic.

Statement 12: A system is disclosed according to any of preceding Statements 9-11, wherein the housing includes at least one of the following: stainless steel, titanium, and aluminum.

Statement 13: A system is disclosed according to any of preceding Statements 9-12, wherein the desiccant includes molecular sieve.

Statement 14: A system is disclosed according to any of preceding Statements 9-13, wherein the desiccant holds the predetermined threshold amount of moisture at a predetermined threshold temperature, the predetermined threshold temperature being up to about 350 degrees Fahrenheit.

Statement 15: A system is disclosed according to any of preceding Statements 9-14, further comprising: a cover operable to prevent impact force against the housing, the cover forming one or more vents through which the moisture can pass through.

Statement 16: A system is disclosed according to any of preceding Statements 9-15, further comprising a retaining component disposed within the containment portion, the retaining component operable to at least reduce movement of the desiccant within the containment portion.

Statement 17: A method is disclosed comprising: disposing a desiccating module in a portion of a downhole tool, the portion of the downhole tool containing an electronic component which is exposed to moisture present within the portion of the downhole tool, the desiccating module including: a housing having a containment portion, the housing being configured to be retained in the downhole tool containing moisture sensitive electronics, the housing configured to permit passage of moisture from outside the housing to the containment portion and to retain the desiccant within the containment portion; and desiccant located in the containment portion of the housing capable of retaining moisture therein, the desiccant having a retention capacity sufficient to hold a predetermined threshold amount of moisture; and sealing the portion of the downhole tool with an enclosure.

Statement 18: A method is disclosed according to Statement 17, further comprising: removing the desiccating module from the downhole tool; and disposing another desiccating module in the downhole tool to adsorb additional moisture.

Statement 19: A method is disclosed according to Statements 17 or 18, wherein the desiccant holds the predetermined threshold amount of moisture at a predetermined threshold temperature, the predetermined threshold temperature being up to about 350 degrees Fahrenheit.

Statement 20: A method is disclosed according to any of preceding Statements 17-19, wherein the housing includes at least one of the following: stainless steel, titanium, and aluminum.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A desiccating module configured to be installed in a downhole tool, the desiccating module comprising:

a housing having a containment portion, the housing being configured to be retained in a downhole tool containing moisture sensitive electronics, the housing configured to permit passage of moisture from outside the housing to the containment portion; and desiccant located in the containment portion of the housing capable of retaining moisture therein, the desiccant having a retention capacity sufficient to hold a predetermined threshold amount of moisture, the predetermined amount of moisture being calculated by the amount of moisture that entrapped within an annulus of an enclosure of the downhole tool after the enclosure is closed and sealed, wherein the housing is configured to retain the desiccant within the containment portion.

2. The desiccating module of claim 1, wherein the housing of the desiccating module further comprises a seat configured for friction-fit, mating engagement within a complementarily configured receiving portion of the downhole tool.

3. The desiccating module of claim 1, wherein the housing is non-magnetic.

4. The desiccating module of claim 1, wherein the housing includes at least one of the following: stainless steel, titanium, and aluminum.

5. The desiccating module of claim 1, wherein the desiccant includes molecular sieve.

6. The desiccating module of claim 1, wherein the desiccant holds the predetermined threshold amount of moisture at a predetermined threshold temperature, the predetermined threshold temperature being up to about 350 degrees Fahrenheit.

7. The desiccating module of claim 1, further comprising:

a cover operable to prevent impact force against the housing, the cover forming one or more vents through which the moisture can pass through.

8. The desiccating module of claim 1, further comprising a retaining component disposed within the containment portion, the retaining component operable to at least reduce movement of the desiccant within the containment portion.

9. A system comprising:

a downhole tool operable to be disposed within a wellbore, the downhole tool including an enclosure operable to enclose a portion of the downhole tool, the enclosure forming an annulus around the portion, the portion of the downhole tool containing moisture sensitive electronics, the moisture sensitive electronics being exposed to moisture present within the annulus; and a desiccating module contained within the enclosure, the desiccating module including:

a housing having a containment portion, the housing being configured to be retained in the downhole tool containing moisture sensitive electronics, the housing configured to permit passage of moisture from outside the housing to the containment portion; and desiccant located in the containment portion of the housing capable of retaining moisture therein, the desiccant having a retention capacity sufficient to hold a predetermined threshold amount of moisture, the predetermined amount of moisture being calculated by the amount of moisture that entrapped within the annulus of the enclosure of the downhole tool after the enclosure is closed and sealed, wherein the housing is configured to retain the desiccant within the containment portion.

10. The system of claim 9, wherein the housing of the desiccating module further comprises a seat configured for friction-fit, mating engagement within a complementarily configured receiving portion of the downhole tool.

11. The system of claim 9, wherein the housing is non-magnetic.

12. The system of claim 9, wherein the housing includes at least one of the following: stainless steel, titanium, and aluminum.

13. The system of claim 9, wherein the desiccant includes molecular sieve.

14. The system of claim 9, wherein the desiccant holds the predetermined threshold amount of moisture at a predetermined threshold temperature, the predetermined threshold temperature being up to about 350 degrees Fahrenheit.

15. The system of claim 9, further comprising:

a cover operable to prevent impact force against the housing, the cover forming one or more vents through which the moisture can pass through.

16. The system of claim 9, further comprising a retaining component disposed within the containment portion, the retaining component operable to at least reduce movement of the desiccant within the containment portion.

17. A method comprising:

disposing a desiccating module in a portion of a downhole tool, the portion of the downhole tool containing an electronic component which is exposed to moisture present within the portion of the downhole tool, the desiccating module including:

a housing having a containment portion, the housing being configured to be retained in the downhole tool containing moisture sensitive electronics, the housing configured to permit passage of moisture from outside the housing to the containment portion; and desiccant located in the containment portion of the housing capable of retaining moisture therein, the desiccant having a retention capacity sufficient to hold a predetermined threshold amount of moisture, the predetermined amount of moisture being calculated by the amount of moisture that entrapped within an annulus of an enclosure of the downhole tool after the enclosure is closed and sealed, wherein the housing is configured to retain the desiccant within the containment portion; and sealing the portion of the downhole tool with an enclosure.

18. The method of claim 17, further comprising:

removing the desiccating module from the downhole tool; and disposing another desiccating module in the downhole tool to adsorb additional moisture.

19. The method of claim 17, wherein the desiccant holds the predetermined threshold amount of moisture at a predetermined threshold temperature, the predetermined threshold temperature being up to about 350 degrees Fahrenheit.

20. The method of claim 17, wherein the housing includes at least one of the following: stainless steel, titanium, and aluminum.

* * * * *